United States Patent [19]

Otsuka

[11] Patent Number: 4,842,433

[45] Date of Patent: Jun. 27, 1989

[54] PEN TIP STRUCTURE

[75] Inventor: Katsumi Otsuka, Chiba, Japan

[73] Assignee: Teibow Co., Ltd., Shizuoka, Japan

[21] Appl. No.: 69,632

[22] PCT Filed: Oct. 17, 1986

[86] PCT No.: PCT/JP86/00529

§ 371 Date: Jun. 17, 1987

§ 102(e) Date: Jun. 17, 1987

[87] PCT Pub. No.: WO87/02313

PCT Pub. Date: Apr. 23, 1987

[30] Foreign Application Priority Data

Oct. 17, 1985 [JP] Japan ..... 60-229938
Oct. 17, 1985 [JP] Japan ..... 60-229939

[51] Int. Cl.[4] ..... B43K 7/00; B43K 7/10
[52] U.S. Cl. ..... 401/209; 401/216
[58] Field of Search ..... 401/209, 214, 215, 216, 401/199, 208, 212

[56] References Cited

U.S. PATENT DOCUMENTS 2,551,490 5/1951 Ferst et al. ..... 401/216 X
3,537,801 11/1970 Corte ..... 401/216
3,781,123 12/1973 Linz et al. ..... 401/216
3,904,297 9/1975 Hori ..... 401/209 X
3,966,336 6/1976 Lotfallah ..... 401/209
4,139,313 2/1979 Hori ..... 401/216
4,529,329 7/1985 Hirabayashi et al. ..... 401/209
4,603,994 8/1986 Mitsuda et al. ..... 401/209

FOREIGN PATENT DOCUMENTS 566730 12/1958 Canada ..... 401/209
965140 9/1950 France ..... 401/216
66053 5/1956 France ..... 401/209

*Primary Examiner*—Richard J. Apley
*Assistant Examiner*—David J. Bender
*Attorney, Agent, or Firm*—Watson, Cole, Grindle & Watson

[57] ABSTRACT

A pen tip structure for a ball point includes a ball socketed between a pipe tip and the end of an inner core, the end of the inner core having a flat center surface for supporting the ball and an annular lip which flares outwardly from the flat center surface to create a capillary gap between the ball and the pipe tip. Ink is supplied to the ball from a capillary ink flow channel between the inner core and the pipe.

22 Claims, 15 Drawing Sheets

PEN TIP STRUCTURE

BACKGROUND OF THE INVENTION

1. Technical Field

This invention relates to a pen tip structure which includes a rotatable ball socketed between the lip of the pipe and the end of an inner core.

2. The Prior Art

Ball point pens in which the ball at the pen tip part is rotated by frictional resistance during its writing movement so as to draw ink for writing are in, wide use throughout the world. One such known ball point pen utilizes a pen tip structure composed of a ball bearing shaft, a ball holding part within the ball bearing shaft, and a rotatable ball socketed between a bottom surface of the ball holding part and the tip of the ball bearing shaft, the bottom surface of the ball holding part being conically shaped and having an ink passage at its apex. Another known pen tip structure is constructed as shown in FIG. 47, wherein a ball receiving core (51) having a flat bottom surface is fixed in a ball holding pipe (50), with an axial ink passage space (52) being formed therebetween, and a ball (54) is rotatably held in a ball wrapping part (53) which communicates with the ink passage space (52). However, a pen tip structure which utilizes a ball holding part having a conical bottom surface has the following disadvantages:

PROBLEMS IN MANUFACTURING

There are some problems in machining and forming of the ball holding part and an ink passing hole, that is, a high precision in the cutting operation is required in case the ball receiving shaft is made of metal, and a forming mold with a high machining accuracy is required in case the ball receiving shaft is made of plastic material.

PROBLEMS IN ROTATION OF BALL

There are some problems in the writing operation of the pen tip caused by the conical shape of the bottom surface of the ball holding part; that is, the rotation of the ball will be hindered due to a wedging action caused by its biting into the conical bottom surface in proportion to its writing pressure. The result is a poor ink drawing characteristic and a blurred writing phenomenon. This type of pen tip structure is not suitable for a high speed writing operation.

On the other hand, a pen tip structure wherein the ball holding part has a totally flat bottom surface has the following disadvantages:

PROBLEMS IN INK GUIDING OPERATION

The ball receiving part in the ball receiving core (51) at the ball wrapping part (53) may generate a so-called capillary guiding vacant area (61) where no link capillary guiding action is performed in a space (60) formed among an outer side part (57) of the flat bottom surface (56), a surface part (58) of a ball (54) near the outer side and an inner surface part (59) of the ball holding pipe (50). This capillary guiding vacant area (61) may hinder capillary movement of the ink along the surface (58) of the ball (54) and reduce or eliminate the scraping of ink on the surface (58) while the ball (54) is rotated. This phenomenon may occur due to an air winding phenomenon caused by rotation of the ball and a forming of the capillary guiding vacant area (61) due to accumulation of air in the area (60) fed into the ball wrapping part (53). As a result, the holding capacity of the ink in the ball wrapping part (53) is decreased, a drain-back may occur, a blurring of the ink may occur during initial writing, a poor return-back characteristic of ink may occur after the pen tip has been inverted, the supply of ink to the ball will be unstable, excessive blurring of the ink during high-speed writing will occur, and the ink may not follow a rapid change in writing direction.

In view of the facts described above, it is an object of the present invention to provide a pen tip structure having no problems of the conventional type of pen tip structure in which all anti-drain back characteristic of ink, initial writing feature, a return-back feature of ink, high-speed writing characteristic, a stable ink supplying feature, a rotating feature of the ball and a manufacturing characteristic of the ball are superior.

It is another object of the present invention to provide a pen tip structure in which a projecting wall of the pen tip structure is formed at an outside portion of a ball receiving core and the ink capillary guiding capability in the ball wrapping part is improved.

It is yet further object of the present invention to provide a pen tip structure in which projecting walls are formed at the outside part of the ball receiving core and the inner surface of the ball holding pipe, an ink capillary guiding capability in the ball wrapping part and a rotational lubrication of the lubricant of ink in respect to the ball are improved.

It is a further object of the present invention to provide a pen tip structure in which a cross-sectional area of the ink passing space is formed in a certain ratio without changing the ink capillary space rather than a cross sectional area of the capillary guiding passage and an ink capillary guiding ratio in the ink passing space in respect to the ball wrapping part is improved.

It is still further object of the present invention to provide a pen tip structure in which an ink passing space is formed between an outer surface of a ball receiving core having a larger diameter than that of the ball and an inner surface of the ball holding pipe facing to the outer surface so as to improve the amount of ink capillary guiding volume in the ink passing space in respect to the ball wrapping part and the capillary guiding capability.

It is a still further object of the present invention to provide a pen tip structure in which the ink passing space is formed between a substantial trapezoid tapered outer surface having a top surface of the ball receiving part in the ball receiving core and the inner surface of the ball holding pipe parallel to the outer surface, and both the ink capillary guiding volume in the ink passing space in respect to the ball wrapping part and a capillary guiding control capability are improved.

It is a yet further object of the present invention to provide a pen tip structure in which an inner diameter of the ball holding pipe is made to have substantially the same diameter as that of the ball up to the ink passing space forming part except the metering part where the ball is prevented from being pulled off and the diameter of the extremity end of the pen which is approximate to the ball diameter is improved.

It is a still further object of the present invention to provide a pen tip structure in which a cross sectional shape at a diameter part of an inner surface of the ball holding pipe and a contour shape of a cross sectional shape at a diameter part of the ball receiving core are similar and the ink guiding capability at each of the ink passing spaces is improved.

It is a yet further object of the present invention to provide a pen tip structure in which a cross sectional shape at a diameter part of an inner surface of a ball holding pipe and a contour shape of a cross sectional shape at a diameter of the ball receiving core are circular so as to stabilize the ink guiding capability in the ink passing space.

It is a yet further object of the present invention to provide a pen tip structure in which a ball receiving core is formed with a spiral groove axially extending along an ink passing space forming part at its circumferential surface so as to improve the axial flow yielding capability of ink in the ink passing space.

It is a still further object of the present invention to provide a pen tip structure in which a ball receiving core has some parallel axial annular grooves in a circumferential direction at an outer surface part acting as an ink passing space so as to highly improve the axial yielding capacity of ink in the ink passing space.

It is a yet further object of the present invention to provide a pen tip structure in which a ball receiving core has an ink capillary guiding groove communicating with the ink passing space and reaching to a part near the ball receiving part so as to improve the rotational lubricating characteristic of the ball.

It is a still further object of the present invention to provide a pen tip structure in which a ball receiving core is fixed within a ball holding pipe so as to improve a connection between the ball holding pipe and the ball receiving core.

It is a yet further object of the present invention to provide a pen tip structure wherein a fitting part of the pen tip structure is formed as a projection part extending axially so as to improve the bending strength of the pen tip and the axial ink guiding capability in the ink passing space.

It is still further object of the present invention to provide a pen tip structure in which a fitting part of the pen tip structure is formed as a metering shape extending along a circumference of the structure so as to improve the ink guiding capability in a circumferential direction of the ink passing space.

It is still further object of the present invention to provide a pen tip structure in which a ball of the pen tip structure is formed as a ball shape so as to improve its directional characteristic, its angle writing ability and its general writing operation.

It is a still further object of the present invention to provide a pen tip structure in which a ball holding pipe, a ball receiving core and a ball of the pen tip structure are mainly made of the same high hardness material.

It is a yet further object of the present invention to provide a pen tip structure in which a ball holding pipe, a core part in a ball receiving core and a ball of the pen tip structure are mainly made of the same high hardness material and the side surface of the core part is coated with a synthetic resin film so as to improve its electrostatic action and its ink wetting action.

It is a still further object of the present invention to provide a pen tip structure in its which a capillary interval in ink passing space is substantially formed to have a size of 25 to 100μ so as to improve its ink guiding capability.

It is a still further object of the present invention to provide a pen tip structure in which a capillary interval of the capillary guiding passage is made to have a value of about 25 to 100μ so as to improve its ink guiding capability.

It is a yet further object of the present invention to provide a pen tip structure in which a space between an opening edge of a metering part in a ball wrapping part and a ball surface is made to have a value of about 5 to 15μ so as to improve its ink drawing volume at the opening edge and its air winding volume.

It is a still further object of the present invention to provide a pen tip structure in which a capillary guiding groove of a ball receiving core is made to have a groove width value of about 25 to 110μ and with a depth of about 100 to 20μ so as to improve its range of ink guiding capability.

SUMMARY OF THE INVENTION

In detail, the pen tip structure of the present invention is made such that a ball receiving core is fixed in a ball holding pipe, a ball is rotatably supported in the ball wrapping part and at the same time the ink passing space communicating with the ball wrapping part is formed in such a way that the ink is axially moved in a capillary form between the outer surface of the ball receiving core and the inner surface of the ball holding pipe, a projecting wall is formed at a part between the substantial flat outside part of the ball receiving portion of the ball receiving core in the ball wrapping part, a ball surface part and the inner surface part of the ball holding pipe, and the ink capillary guiding passage communicating with the ink passing space is formed between the ball receiving core and the ball surface part.

With this arrangement, the following advantages can be attained.

(1) The ball wedging action at the ball receiving part in the ball wrapping part is overcome and at the same time a circumference of the ball surface in the ball wrapping part is uniformly enclosed with the ink capillary guiding passage caused by the projecting wall so as to eliminate the presence of an ink capillary guiding vacant area, and the surface of the ball in the ball wrapping part can be rotated better with less rotational resistance can be wet and wrapped with pooled ink under a capillary action between it and the ball surface. With this arrangement, ink may not be drained back in the ball wrapping part, a superior anti-drain back characteristic can be attained, an initial writing can be preformed without any blurring of ink from the starting of a writing operation, the ink is guided up to the ball surface under a capillary action, a superior ink returning-back characteristic can be attained after an upward-directed orientation of the pen tip, a stable supplying of ink and a rotating characteristic of ball are well attained, no slippage of pen tip on the sheet surface due to an insufficient rotation of the ball during a high-speed writing operation will occur, and the supply of ink during high-speed writing can be assured.

(2) The above-described ball wrapping part and the ink passing space for capillary guiding the ink to the ball wrapping part can easily be formed with a combined assembly of the ball holding pipe and the ball receiving core.

(3) The ink passing space at a sectional surface at a diameter in the pen tip is kept in the maximum capillary area in the limited range.

The present invention is made such that the projecting wall having the above-described improved structure of the pen tip is formed at the outside part of the ball receiving core.

With this arrangement, the following advantages can be attained.

(4) The projecting wall part can be formed relatively easily and high accurately at the end surface of the ball receiving rod-like core by a rolling machining or the like together with the ball receiving part, capillary intervals in the capillary guiding passage can correctly be controlled and the capillary guiding capability of the ink is made uniform in a superior manner.

The present invention is further made such that the projecting walls of the above-described improved pen tip structure are formed at the outside part of the ball receiving core and the inner surface of the ball holding pipe.

The following advantages can be attained.

(5) The projecting walls are separately arranged at the ball receiving core and the ball holding pipe, a machining accuracy of each of them is highly applied to get a high accuracy, so that the intervals of the capillary guiding passages can be more accurately controlled and the guiding capability of the ink capillary action is highly uniformed. The ink is forcedly guided to the ball receiving part as lubricant agent and a more smooth rotation of the ball can be attained.

The present invention is made such that a cross sectional area of the ink passing space of the above-described improved pen tip is made to show a higher ratio without changing the interval of the ink capillary portions that a cross sectional area of the capillary guiding passage.

With the foregoing arrangement, the following advantages can be attained.

(6) Amount of ink more than the comsumption volume of ink drawn from the ball wrapping part with the ball can be guided from the ink passing space to the capillary guiding passage in a capillary form and no blurring of ink caused by a lack of supplying of ink is found during a high-speed writing operation.

Further, the present invention is made such that the ink passing space in the above-described improved pen tip structure is formed between the outer surface part of the ball receiving core of which diameter is larger than that of the ball and the inner surface of the ball holding pipe facing to the outer surface.

With the above arrangement, the following advantages can be attained.

(7) An amount of ink exceeding over an amount of consumption of ink drawn from the ball wrapping part with the ball can be supplied from the ink passing space under a guiding of capillary action and at the same time both an outer diameter of the outer surface of the ball receiving core and an inner diameter of the ball holding pipe can easily be controlled, a desired capillary interval can accurately be attained and a capability of the ink capillary guiding action is uniformly settled.

Further, the present invention is made such that the ink passing space of the above-described improved pen tip structure is formed between a tapered outer surface of substantial trapezoid shape having a top end surface of the ball receiving core facing to the ball receiving part and the inner surface of the ball holding pipe which is parallel with the outer surface.

With this arrangement, the following advantages can be attained.

(8) An amount of ink exceeding over a consumption volume of ink drawn from the ball wrapping part with the ball can be supplied in capillary guiding from the ink passing space and at the same time the ink capillary guiding volume between the ink passing space and the capillary guiding passage is gradually metered from the ink passing space to the capillary guiding passage, so that the ink capillary movement is quite smoothly performed and a controlled ink movement is also performed.

Further, the present invention is made such that an inner diameter of the ball holding pipe of the above-described improved pen tip structure is formed to a substantial same diameter as the ball diameter up to the ink passing space forming part except the metering part preventing the ball from being pulled out.

With this arrangement, the following advantages are attained.

(9) The pen tip having a diameter which is approximate to the ball diameter can be attained.

Further the present invention is made such that a sectional shape at a diameter of the inner surface of the ball holding pipe of the above-described improved pen tip structure and a contour shape of a section at a diameter of the ball receiving core are formed in a similar shape.

With this arrangement, the following advantages are attained.

(10) A substantial balanced capillary action at each of the component parts is made due to the fact that the intervals of each of the parts in the ink passing space are similar to each other and then a superior ink guiding capability is attained.

Further, the present invention is made such that a sectional shape at a diameter of an inner surface of the ball holding pipe of the above-described improved pen tip structure and a contuour shape at a sectional surface of the ball receiving core are formed as circles.

With this arrangement, the following advantages are attained.

(11) Intervals at each of the parts of the ink passing space are made equal, the ink guiding capability in the ink passing space are equal and a stable operation can be attained by each of the parts generating a stable capillary action.

Further, the present invention is made such that an axial and spiral groove is formed at a part where the ink passing space of an outer surface of the ball receiving core of the above-described improved pen tip structure.

With this arrangement, the following advantages are attained.

(12) The axial straight flow of the ink is restricted, a superior ink yielding action is attained and a better anti-drain back characteristic of ink in the ink passing space is attained.

Further, the present invention is made such that circumferential annular grooves are axially arranged in parallel at the ink passing space forming part of an outer surface of the ball receiving core of the above-described improved pen tip structure.

With this arrangement, the following advantages are attained.

(13) A superior ink yielding in the ink passing space is attained and an anti-drain back characteristic of ink is further enforced.

Further, the present invention is made such that the ink capillary guiding groove communicating with the ink passing space and reaching to a part near the ball receiving part is formed at an outside part of the ball receiving core of the above-described improved pen tip structure.

With this arrangement, the following advantages are attained.

(14) The ink is forcedly capillary guided as lubricant agent from the ink passing space to the ball receiving part so as to promote a smooth rotation of the ball.

Further, the present invention is made such that the ball receiving core of the above-described improved pen tip structure is fixedly fitted in the ball holding pipe.

With this arrangement, the following advantages are attained.

(15) The ball holding pipe and the ball receiving core are easily coupled to make an integral structure.

Further, the present invention is made such that a fitting part of the above-described improved pen tip structure is axially formed to have a projecting shape.

With this arrangement, the following advantages are attained.

(16) A high bending strength of the pen tip under a wedging action of the fitting part is attained, a block-formed rectangular ink passing space along the fitting part keeps an axial capillary action and a superior ink guiding capability is attained.

Further, the present invention is made such that a fitting part of the above-described improved pen tip structure is formed as a metering part extending in a circumferential direction.

With this arrangement, the following advantages are attained.

(17) Both axial and circumferential capillary actions in the ink passing space are kept and a superior ink guiding capability is obtained.

Further, the present invention is made such that the ball of the above-described improved pen tip structure is spherical.

With this arrangement, the following advantages are attained.

(18) There is no limitation in the writing process and the writing angle and a variety of applications, including writing, drawing and artificial hair lining such as eye shadow or eye brow writings are possible.

Further, the present invention is made such that the ball holding pipe and the ball receiving core of the above-described improved pen tip structure are made of stainless steel and the ball is made of stainless steel or ceramics.

With this arrangement, the following advantages are attained.

(19) A high hardness is attained, a high durability is also obtained and further no corrosion caused by an electric potential, that is, no electrostatic action results, rust formation due to electrostatic action and a decreased capability of the ink guiding action due to rust clogging is eliminated and a non-variable ink guiding capability is retained.

Further, the present invention is made such that the ball holding pipe of the above-described improved pen tip structure is made of stainless steel, the ball is made of stainless steel or ceramics and the ball receiving core is made by coating synthetic resin film on the side surface of the stainless core part, respectively.

With this arrangment, the following advantages are attained.

(20) A high hardness is attained, a sufficient durability is obtained and at the same time no electrostatic action is generated and the disadvantages caused by the electrostatic action are eliminated, a constant ink guiding capability is kept and an ink wetting characteristic at a circumferential side surface of the ball receiving core in the ink passing space is stabled at a high level.

Further, the present invention is made such that the capillary spacings in the ink passing space of the above-described improved pen tip structure are made to have an approximate value of 25 to 100μ.

With this arrangement, the following advantages are attained.

(21) A superior capillary action is performed and a moderate and stable volume of ink is guided to the capillary guiding passage in the ball wrapping part.

Further, the present invention is made such that the intervals of the capillary guiding passages of the above-described improved pen tip structure are made to have an approximate value of 25 to 100μ.

With this arrangement, the following advantages are attained.

(22) A superior capillary action is obtained and a moderate and stable guiding of ink from the ink passing space to the ball surface is attained.

Further, the present invention is made such that a space between the opening edge of the metering part and the ball surface in the above-described improved pen tip structure is made to have an approximate value of 5 to 15μ.

With this arrangement, the following advantages are attained.

(23) The pen tip structure is properly controlled to have such a proper drawing degree as no ink dropping at the opening edge or no excessive blurring of ink is made, a superior ink drawing is performed and the pen tip is further controlled to hinder an air winding action caused by a rotation of the ball, resulting in that an air winding is scarcely found and therefore the ball surface is not applied with the winding air, but always applied with ink in such a way as the ink is scraped with the ball at its surface part.

Further, the present invention is made such that the capillary guiding groove of the above-described improved pen tip structure is formed to have a groove width of about 25 to 100μ and a groove depth of about 100 to 20μ.

With this arrangement, the following advantages are attained.

(24) A superior capillary guiding of ink is performed from the ink passing space to the ball receiving part.

BRIEF DESCRIPTION OF THE DRAWINGS

The accompanying drawings illustrate of the pen tip structure of the present invention.

FIG. 22 is a perspective view of the roll-form ball.

FIGS. 26 and 30 are perspective views of the respective ball wrapping parts, portions of which are broken away.

MOST PREFERRED EMBODIMENTS FOR PERFORMING THE INVENTION

Figure 1:
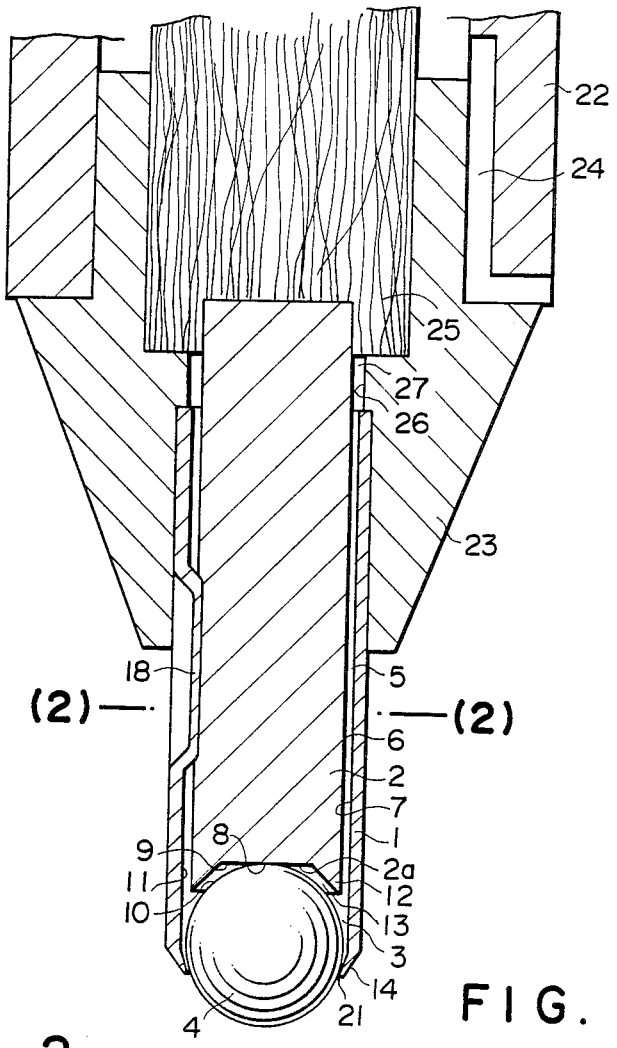
FIG. 1 is a longitudinal sectional view through a pen tip structure according to one embodiment of the present invention.
Figure 2:
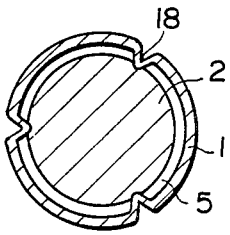
FIG. 2 is a cross sectional view taken along a line (2)—(2) of FIG. 1.
Figure 3:
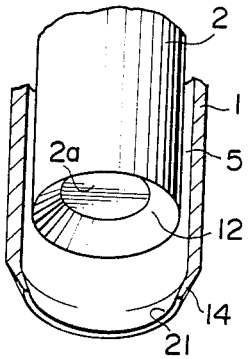
FIG. 3 is a perspective view of the ball wrapping part at the lower end of the pen tip structure in FIG. 1, a portion of which is broken away.

Referring now to the drawings,

FIGS. 1 to 3 illustrate a basic pen tip structure according to the present invention. This pen tip is comprised of three component elements: a ball holding pipe (1), a ball receiving core (2) fixed in the ball holding pipe (1), and a ball (4) which is rotatably held in a ball wrapping part (3) formed by the ball receiving core (2) in the extremity end of the ball holding pipe (1) and by the end surface part **(2*a*)**.

The ball holding pipe (1) integrally stores a ball receiving core (2) of small diameter of which ratio in respect to that of the ball holding pipe is set to enable a clearance for capillary moving of ink to be formed between the inner surface of the ball holding pipe and the ball receiving core with the proper locations of the ball holding pipe being press fitted to the core. An ink passing air path (5) is axially formed between an outside surface (6) of the ball receiving core (2) and the inner surface (7). An extremity inner end of the pipe is formed with a ball wrapping part (3) having a bottom surface of an end surface part **(2*a*) of the ball receiving core (2), thereby a ball (4) is rotatably stored in it. The ball is held by a metered part (14) of an opening edge (21) of the ball wrapping part (3) in such a way as the ball may not be dropped off the ball wrapping part (3). The press fitting portions (18) of the ball holding pipe (1) are in a projected belt type extending from a part near the end surface (2*a*) of the ball receiving core (2) to an axially spaced-apart proper location while being circumferentially projected under an axial equally spaced-apart relation. The ball receiving core (2) is equally press fitted by the press fitting portions at its circumference, the ball holding pipe (1) and the ball receiving core (2) are integrally assembled with their bending strength i.e. rigidity being increased and at the same time the ink passing space (5) is made to have a uniform axial clearance and a uniform clearance in its direction of diameter. Since an ink adhering surface thickness of the ball (4) is about 3 to 4$\mu$, it is sufficient to have a capillary clearance of the ink passing path (5)** of at least more than 3 to 6$\mu$. Its practical value is about 25 to 100$\mu$ enabling a low viscosity ink to be capillary guided and this value is set in response to physical properties such as ink viscosity or the like.

The ball receiving core (2) is a solid component having a desired diameter capable of forming the ink passing space (5) between it and the inner surface (7) of the ball holding pipe (1). At a central part of an end surface **(2*a*) forming the bottom side in the ball wrapping part (3) is formed a substantial flat ball receiving part (8) to reduce the rotational resistance of the ball (4) supported at a point on the ball receiving portion (8). At an outside part (9) communicating with the ink passing space (5) surrounding the ball receiving part (8) is formed an annular projecting wall (12)** in such a way as an ink capillary guiding path (13) is established between it and the surface (10) of the ball (4), thereby the ink is capillary guided from the ink passing space (5) to the capillary guiding path (13), i.e., the surface (10) of the ball (4) and stored in the capillary guiding path (13) at the surface part (10). Interval of the capillary tubes of the capillary guiding path (13) is approximately 25 to 100μ and this value is set in response to physical properties such as viscosity of low viscosity ink or the like.

Further, the ball receiving part (8) in the ball receiving core (2) and the projecting wall (12) may easily and high accurately be manufactured by a rolling work or the like if their constituting material can be plastically machined, e.g. a metal.

The ball (4) is held in the ball wrapping part (3) with the metered part (14) at the extremity end of the ball holding pipe (1) so as not to be pulled off and as the ball is rotated, the ink is wiped from the ink passing space (5) into the capillary guiding passage (13) with one of the surfaces (10) and then the ink is further wiped with the other surface (10) and drawn out between the opening edge (21) of the metered part (14) and the ball surface. Diameter of the ball (4) is about 0.3 to 1 mm and a space between the opening edge (21) and the surface of the ball (4) is preferably about 5 to 15μ.

The projecting wall (12) in the ball wrapping part (3) is formed at its outside part (9) and/or inner surface part (11) at a location among the outside part (9) of the ball receiving core (2), the surface part (10) of the ball (4) near the outside part and the inner surface part (11) of the ball holding pipe (1) in response to a capillary guiding capability of the capillary guiding path (13) and a lubricating capability under a rotation of the ball or the like.

Similarly, the ink passing space (5) is set such that either a diameter ratio or shape and constitution of the ball receiving core (2) in respect to the ball (4) are selected in response to the variation of consumption volume of ink caused by a writing speed.

Similarly, the constituting material of the ball holding pipe (1) and the ball receiving core (2) are selected from a combination of round pipe and round rod, or a combination of rectangular pipe and rectangular rod, or a combination of round pipe and rectangular rod and a combination of rectangular pipe and round rod, respectively, in response to a strength of the pen tip and a capillary guiding capability of the ink passing space (5).

Similarly, the shape of the ball (4) is selected to have a spherical one or a roll-form in response to its application.

Further, material quality of the ball holding pipe (1), ball receiving core (2) and ball (4) is selected from metallic material such as stainless steel of SUS304 or the like, super engineering plastics such as polyether ether ketone (PEEK), polyimide (PIM), polyphenilene sulfide (PPS) or the like and other plastic materials such as polyoxymethylene (POM), etc., and ceramic material in response to application, workability and electrostatic feature or the like.

For example, in case that the application is of a pen tip of a ball pen or the like, the metallic material and ceramic material are preferable and in turn for application of make-up, a plastic material showing a soft touch is preferable. In view of the machining characteristic and ink-proof characteristic, a stainless steel material of which rolling work of plastic machining or the like is relatively easy and of which anti-corrosion property is high is economically in preference and at the same time it is preferable in respect to its electrostatic feature.

The above-described pen tip structure is closely fitted to a cap (23) of a pen shaft (22) provided with an air hole (24), the end part of the ball receiving core (2) is inserted into an ink intermediate core or ink immersed body (25) composed of fibrous flux and the ink is supplied through the ink capillary guiding action performed via ink capillary guiding part (27) between the inner surface (26) of the cap (23) and the ball receiving core (2).

FIGS. 4 to 9 illustrate a pen tip structure in which each of the preferred embodiments of the projecting wall (12) of the present invention is different to each other and the remaining component elements are basically the same as those of the earlier preferred embodiment. A sectional shape at a diameter of an inner surface of the ball holding pipe (1) and a contour shape of a section at a diameter of the ball receiving core (2) are similarly circular.

Figure 4:
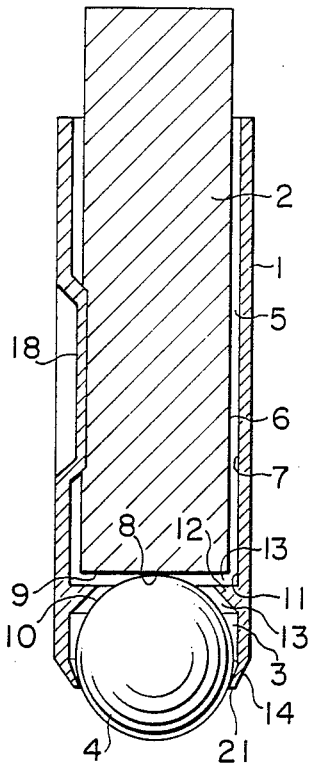
FIGS. 4 to 9 are illustrative views of pen tip structures in which a sectional shape at an inner surface of a ball holding pipe and a contour shape at a sectional surface at a diameter of a ball receiving core are similarly circular but wherein the projecting walls are different from each other FIGS. 4, 6 and 8 being longitudinal sections and FIGS. 5, 7 and 9 being perspective views ball of the respective wrapping parts, portions of which are broken away.
Figure 5:
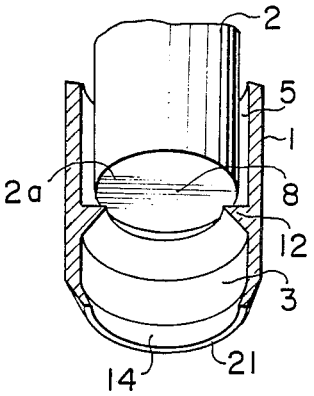

FIGS. 4 and 5 illustrate the pen tip structure in which the projecting wall (12) of the present invention is made in an annular form at the inner surface part of the ball holding pipe (1), and the projecting wall part (12) forms ink capillary guiding paths (13) communicated to each other between the outside part (9) of the ball receiving core (2) and the surface part (10) of the ball (4), respectively. The ink capillary guided from the ink passing space (5) is passed and guided to the ball receiving part (8), thereafter capillary guided to the surface part (10) so as to eliminate an ink capillary guiding vacant area at locations among the outside part (9), surface part (10) and inner surface part (11), and at the same time to lubricate a rotation of the ball (4).

Figure 6:
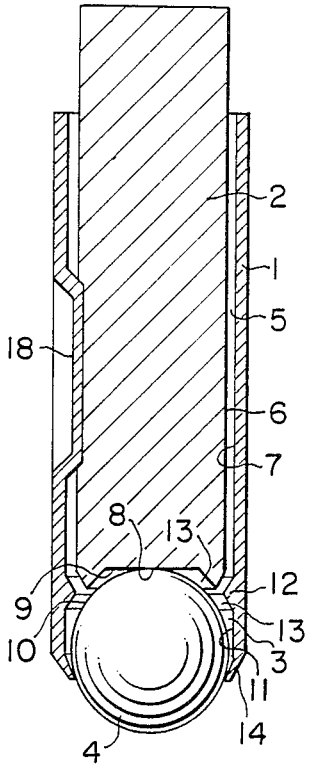
Figure 7:
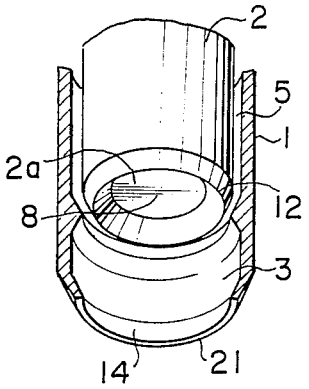

FIGS. 6 and 7 illustrate the pen tip structure in which projecting walls (12) of the present invention are made in an annular form at each of both inner surface (11) of the ball holding pipe (1) and outside part (9) of the ball receiving core (2). Each of the projecting walls (12) form the ink capillary guiding passages (13) communicating to each other between it and the surface part (10) of th ball (4) so as to guide a part of the ink capillary guided from the ink passing space (5) to the ball receiving part (8) and further to eliminate the ink capillary guiding vacant area among the outside part (9), surface part (10) and the inner surface (11) and at the same time to lubricate the rotation of the ball (4).

Figure 8:
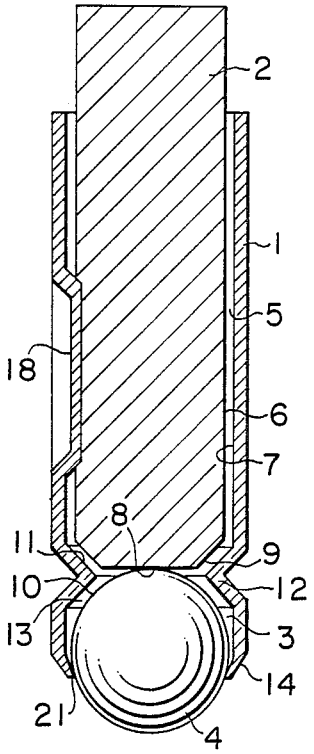
Figure 9:
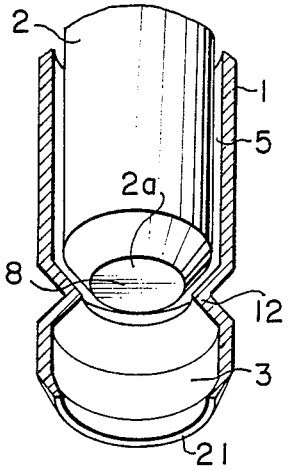

FIGS. 8 and 9 illustrate the pen tip structure in which the projecting wall (12) of the present invention is metered in an annular form at the inner surface of the ball holding pipe (1). The projecting wall (12) forms an ink capillary guiding passage (13) between it and the surface part (10) of the ball (4) so as to feed and guide the ink capillary guided from the ink passing space (5) to the ball receiving part (8), thereafter to capillary guide the ink to the surface part (10) and eliminate the ink capillary guiding vacant area at locations among the outside part (9), surface part (10) and the inner surface part (11) and at the same time to lubricate the rotation of the ball (4).

FIGS. 10 to 18 illustrate the pen tip structure in which each of the preferred embodiments having a larger cross sectional area of the ink passing space (5) of the present invention than that of the capillary guiding passage (13) without varying the interval of the capillary tubes is made different to each other and the remaining component elements are basically the same as those of the earlier case. A sectional shape at a diameter of the inner surface of the ball holding pipe (11) and a contour shape at a section of a diameter of the ball receiving core (2) are similarly circular.

Figure 10:
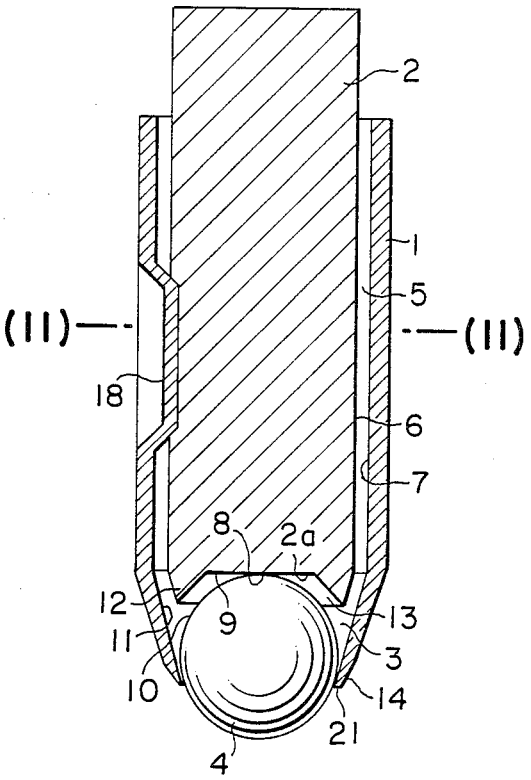
FIGS. 10 to 18 illustrate pen tip structures in which a sectional shape at a diameter of an inner surface of the ball holding pipe and a contour shape of a section at a diameter of the ball receiving core are similarly circular, the cross sectional area of the ink passing space being larger than that of the capillary guiding passage, but wherein the projecting walls is different from each other, FIGS. 10, 13, 15 and 17 being longitudinal sections, FIG. 11 being a cross sectional view taken along a line (11)—(11) of FIG. 10, and FIGS. 12, 14, 16 and 18 being perspective views of the respective ball wrapping parts, portions of which are broken away.
Figure 11:
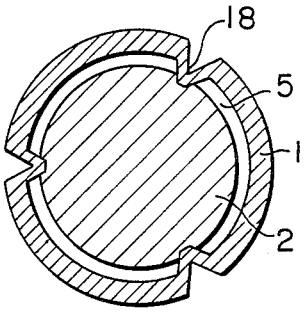
Figure 12:
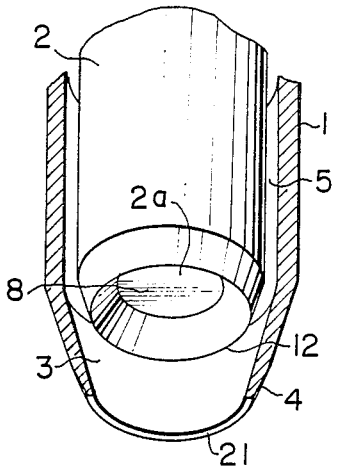

FIGS. 10 to 12 illustrate a pen tip structure in which the ink passing space (5) of the present invention is formed between the outside part (6) of the ball receiving core (2) of which diameter is larger than that of the ball (4) and the inner surface (7) of the ball holding pipe (1) facing to the outside part. This ink passing space (5) forms a cross sectional area larger than the capillary guiding passage (13) and an amount of ink exceeding over the amount of ink normally drawn from the capillary guiding passage (13) by the ball (4) is capillary guided in response to the amount of drawing action and the amount of consumption of the ink corresponding to the variation in writing speed is supplied under a capillary action.

FIGS. 13 to 18 illustrate a pen tip structure in which an ink passing space (5) of the present invention is made to have a larger diameter of the ball receiving core (2) than that of the ball (4) and at the same time it is formed between a tapered outer surface (6) of a substantial trapezoid shape with a top end of the ball receiving part (8) and the inner surface (7) of the ball holding pipe (1) which is parallel to the outer surface. This ink passing space (5) is made such that a difference in a ratio of cross sectional areas of the ink passing space and the capillary guiding passage (13) as the former is approached to the latter. An amount of ink exceeding over an amount of ink normally drawn from the capillary guiding passage (13) with the ball (4) is capillary guided in response to the amount of drawn ink and at the same time a difference between the ink guiding and supplying volumes in respect to the capillary guiding passage is eliminated in a stepwise manner, thereby the amount of ink corresponding to the consumption amount of ink is always supplied in capillary action sufficiently even under a rapid variation of the writing speed.

FIGS. 19 to 22 illustrate a pen tip structure in which a cross sectional shape at a diameter of an inner surface of the ball holding pipe (1) of the present invention and a contour shape at a section of a diameter of the ball receiving core (2) are similarly rectangular, the ball (4) is in a roll form, and the remaining component elements are basically the same as those of the earlier case. The ball holding pipe (1) is a rectangular pipe and the ball receiving core (2) is a rectangular rod.

The projecting wall part (12) at the end surface (2*a*) of the ball receiving core (2) is arranged around and along both sides of the roll-like ball (4) in parallel thereto and forms the ink capillary guiding passage (13) between it and the surface (10) to eliminate the ink capillary guiding vacant area at locations among the outside part (9), surface part (10) and the inner surface part (11). The press fitting part (18) is a spot press fitting.

In this preferred embodiment, in particular a writing direction is provided and a width of the roll corresponds to a writing width.

FIGS. 23 to 30 illustrate a pen tip structure in which a sectional shape at a diameter of the inner surface of the ball holding pipe (1) of the present invention and the contour shape of a section at a diameter of the ball receiving core (2) are made in an irregular form and the remaining component elements are the same as those of the earlier case.

FIGS. 23 to 26 illustrate the pen tip structure in which a sectional shape at a diameter of the inner surface of the ball holding pipe (1) of the present invention is a circular shape, a contour shape at a section at a diameter of the ball receiving core (2) is a rectangular shape, this round pipe and the rectangular rod are combined to each other, and the remaining component elements are the same as those of the earlier case. The ball (4) is a spherical member.

The ink passing spaces (5) in this pen tip are separately and independently divided in correspondence with the number of the outer surfaces (6) between the inner surface (7) of the ball holding pipe (1) and the outer surfaces (6) of the ball receiving core (2). The press fitting part (18) is a planer metered press fitting in a circumferential direction.

FIGS. 27 to 30 illustrate the pen tip structure in which a sectional shape at a diameter of the inner surface of the ball holding pipe (1) of the present invention is a rectangular form and a contour shape of a section at a diameter of the ball receiving core (2) is a circular form, this rectangular pipe and the round rod are combined to each other and the remaining component elements are the same as those of the earlier case. The ball (4) at this pen tip is preferably a roll form and the projecting wall portions (12) at the end surface part (2*a*) are arranged at both sides of the surface part (10) of the roll-like ball (4) in parallel thereto and form between them and the surface part (10) the ink capillary guiding passage (13).

Further, the ink passing spaces (5) are separately and independently divided in correspondence with the number of corners of the ball holding pipe (1) between the inner surface (7) of each of the corners of the ball holding pipe (1) of which sectional shape at its diameter part is rectangular form and the outer surface (6) of the ball receiving core (2) of which sectional shape at its diameter part is circle. The press fitting part (18) is a planer metered press fitting in a circumferential direction.

FIGS. 31 to 36 illustrate the pen tip structure in which the outer surface (6) of the ball receiving core (2) of the present invention is formed as a single or a double spiral groove (15) and the remaining component elements are basically the same as those of the earlier case. This spiral groove (15) forms the inner circumferential side of the ink passing space (5) so as to restrict an axial straight flow of ink in the passing space (5).

Figure 37:
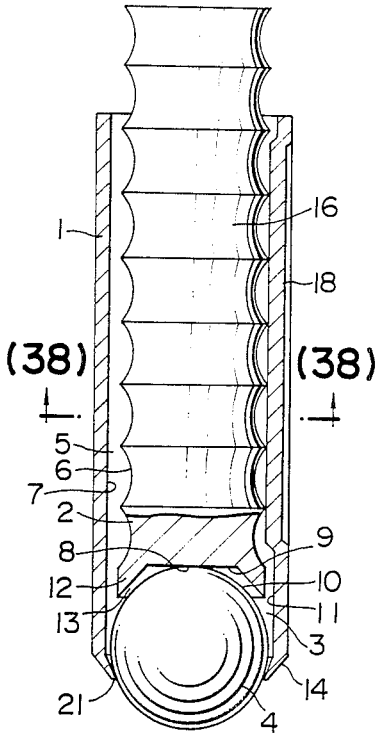
Figure 35:
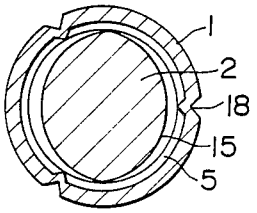
Figure 38:
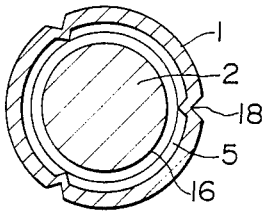
Figure 36:
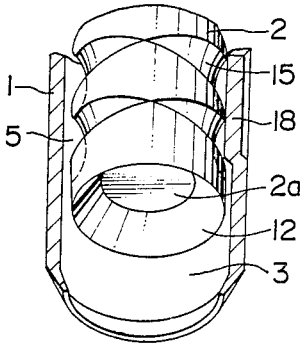
Figure 39:
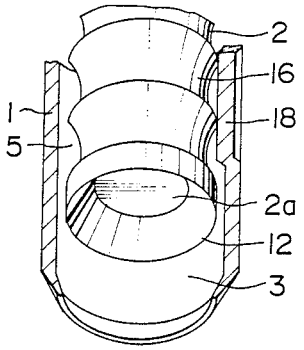
Figure 40:
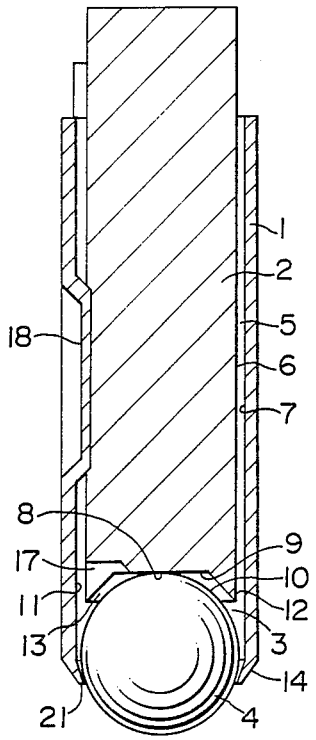
FIGS. 40 to 43 illustrate pen tip structures in which a capillary guiding groove is arranged along an outside part of the ball wrapping part, FIGS. 40 and 42 being longitudinal sections, FIGS. 41 and 43 being perspective views of the respective ball wrapping parts, portions of which are broken away.
Figure 42:
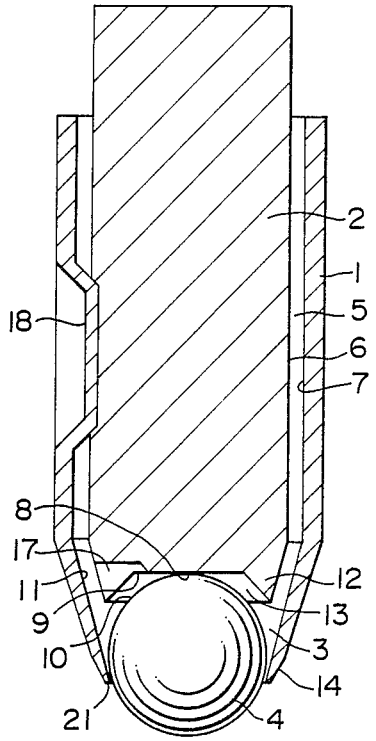
Figure 41:
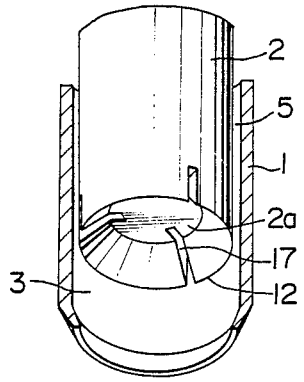
Figure 43:
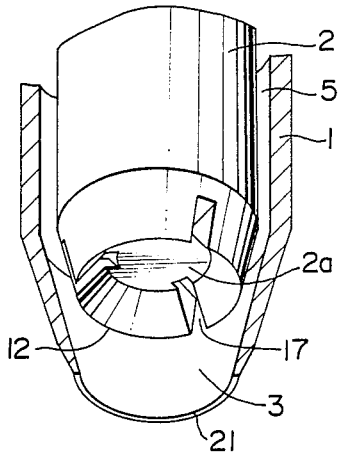

FIGS. 37 to 39 illustrate the pen tip structure in which the outer surface (6) of the ball receiving core (2) of the present invention is formed with axial parallel annular grooves (16) extending in a circumferential direction and the remaining component elements are basically the same as those of the earlier case, the annular groove (16) forms the inner circumference of the ink passing space (5) so as to restrict an axial straight flow of the ink in the passing space (5).

FIGS. 40 to 43 illustrate a pen tip structure in which the outer surface (9) of the ball receiving core (2) of the present invention forms the ink capillary guiding groove (17) and the remaining component elements are basically the same as those of the earlier case. This capillary guiding groove (17) is arranged at the outer side (9) extending up to the ball receiving part (8) so as to capillary guide the ink from the ink passing space (5) to the ball receiving part (8) and to improve the lubrication for a rotation of the ball (4) at the ball receiving part (8).

Figure 44:
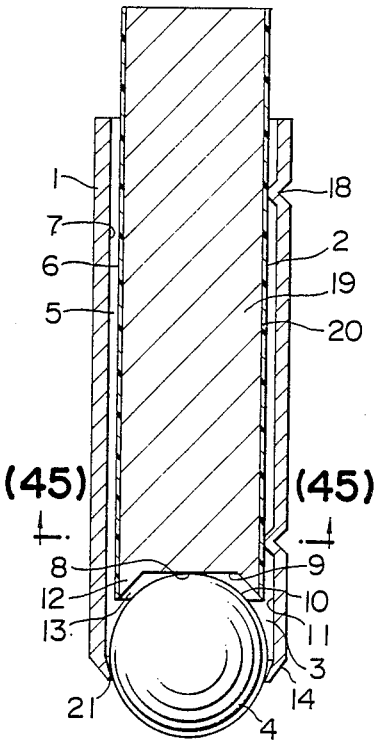
FIGS. 44 to 46 are an illustration of a pen tip structure in which a press fitting between the ball holding pipe and the ball receiving core is in substantially point form, FIG. 47 being a longitudinal section, FIG. 45 being cross sectional view taken along a line (45)—(45) of FIG. 44, FIG. 46 being a perspective view of the ball wrapping part, a portion which is broken away.
Figure 45:
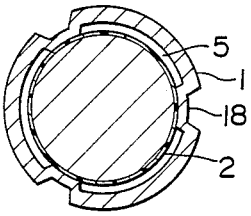
Figure 46:
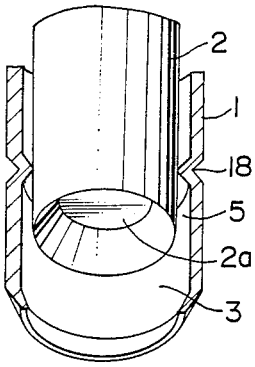

FIGS. 44 to 46 illustrate the pen tip structure in which the ball holding pipe (1) of the present invention is made of stainless steel, the ball receiving core (2) is made such that the side surface of the core part (19) made of stainless steel is coated with synthetic resin film (20), the ball (4) is made of stainless steel and the remaining component elements are basically the same as those of the earlier case. Also in this preferred embodiment, no electrostatic action is generated among the three component elements of the ball holding pipe (1), ball receiving core (2) and the ball (4) and further both corrosion caused by the electrostatic action and generation of rust are eliminated.

Figure 47:
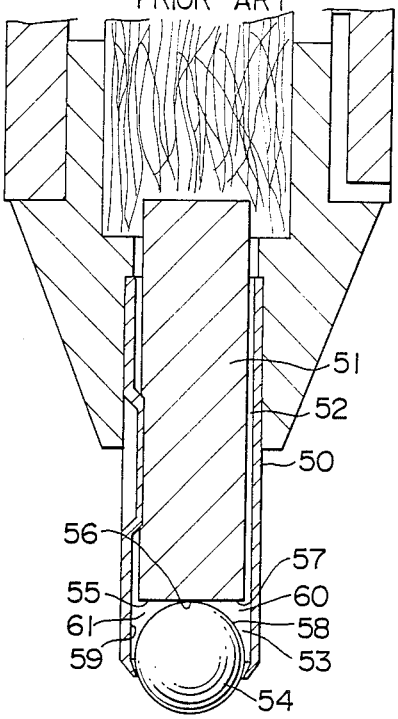
FIG. 47 PRIOR ART
FIG. 47 is a longitudinal section of a conventional type of pen tip structure.
Figure 48:
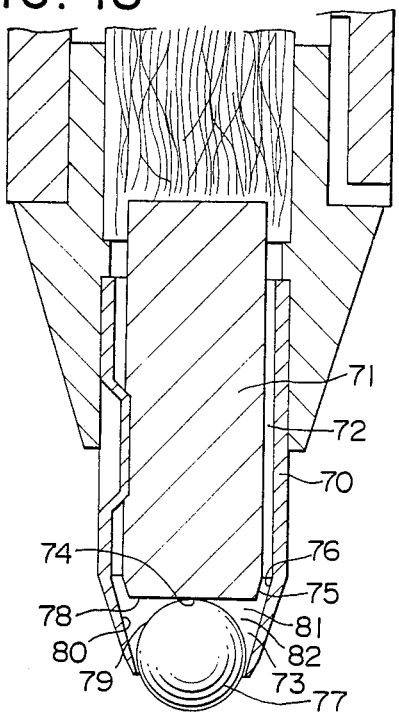
FIG. 48 is a longitudinal section of an experimental pen tip structure for a comparison with the present invention.
Figure 49:
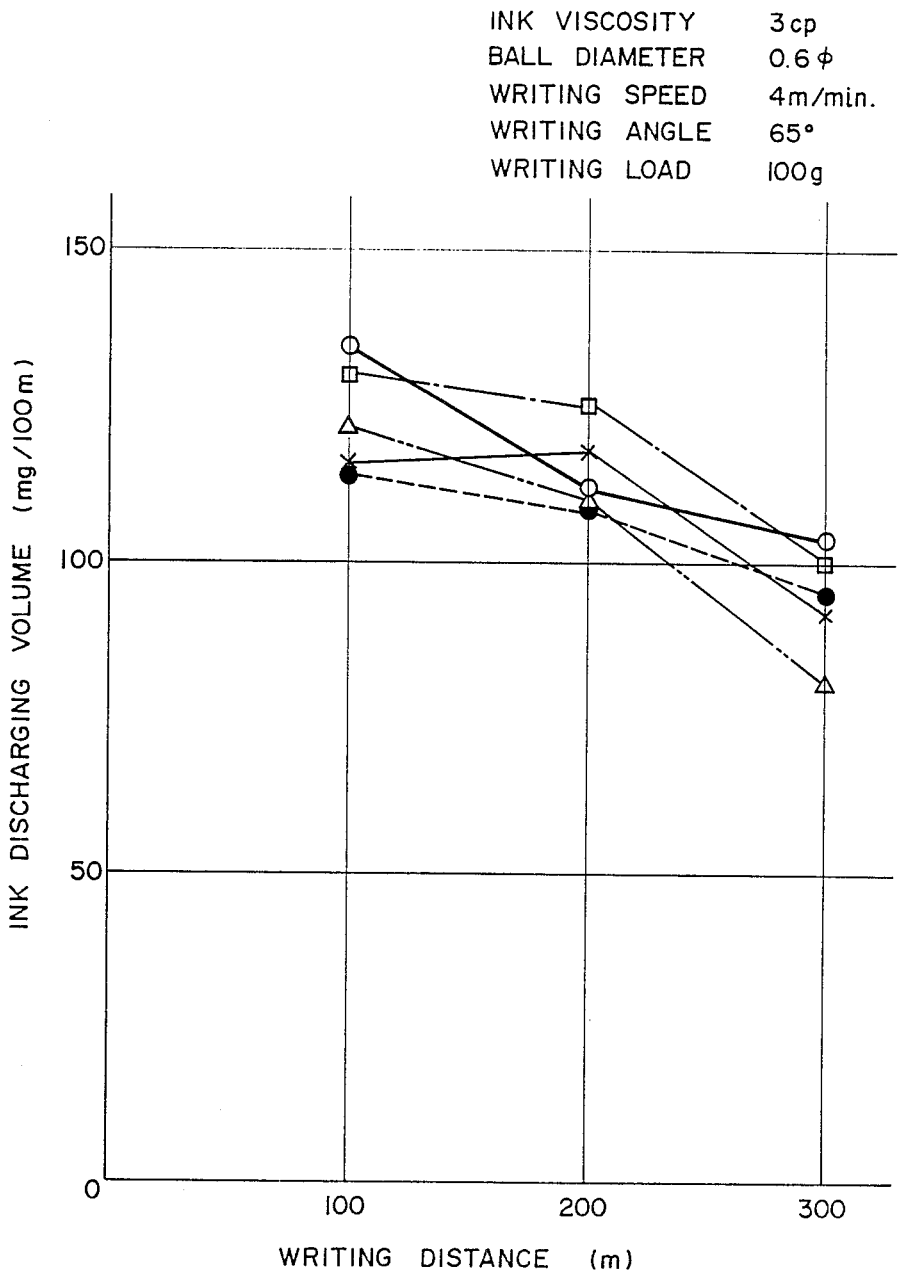
FIGS. 49 to 52 are graphs showing the performance of ink flowing-out volume in the present invention, the conventional type and the experimental product, respectively, FIG. 49 illustrating the ink flowing-out volume in the pen tip structure of the present invention shown in FIG.1, FIG. 50 illustrating the ink flowing-out volume in the pen tip structure of the present invention illustrated in FIG. 13, FIG. 51 illustrating the ink flowing-out volume of the pen tip structure of the prior art shown in FIG. 47, and FIG. 52 illustrating the ink flowing-out volume of a pen tip structure of the experimental product shown in FIG. 48.
Figure 50:
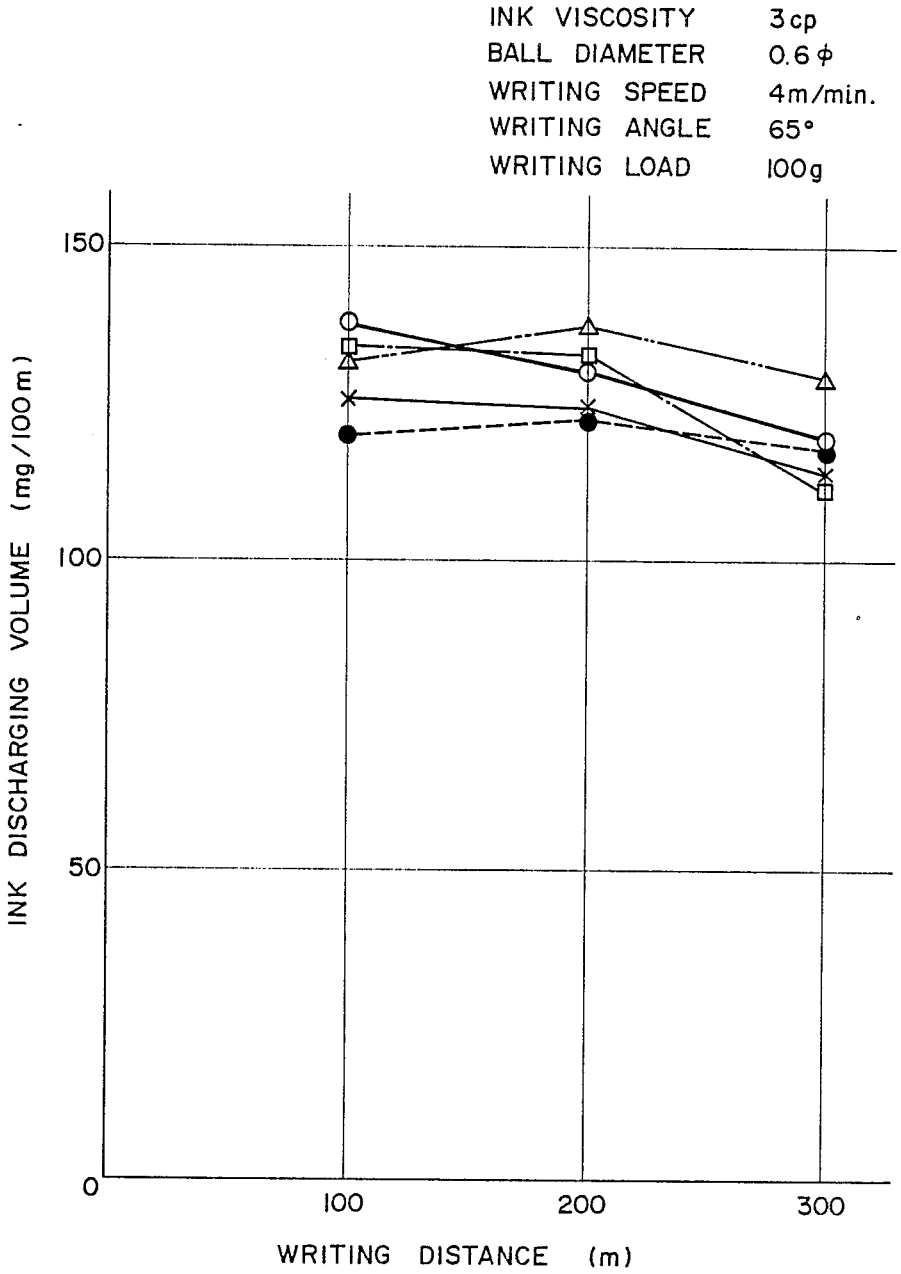
Figure 51:
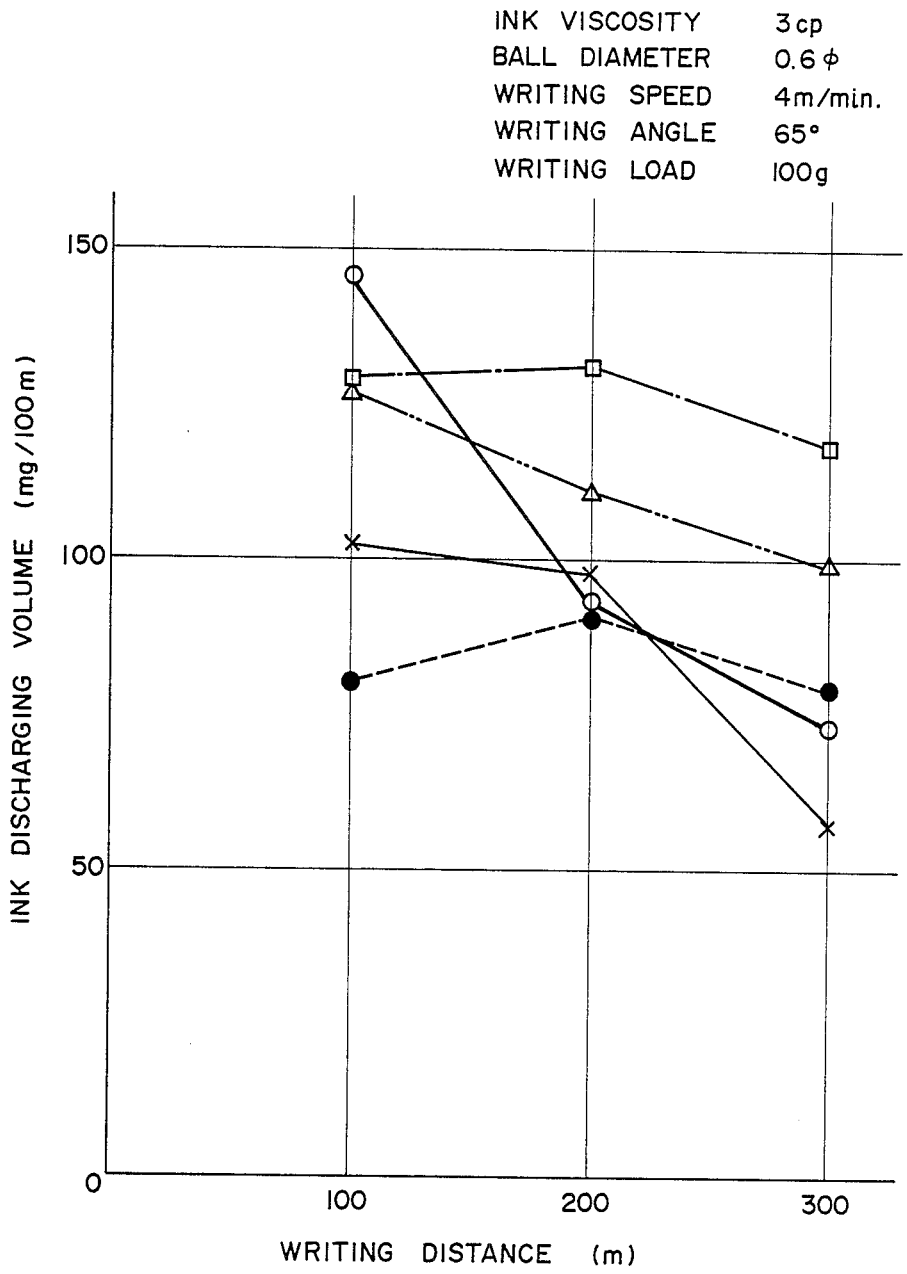
Figure 52:
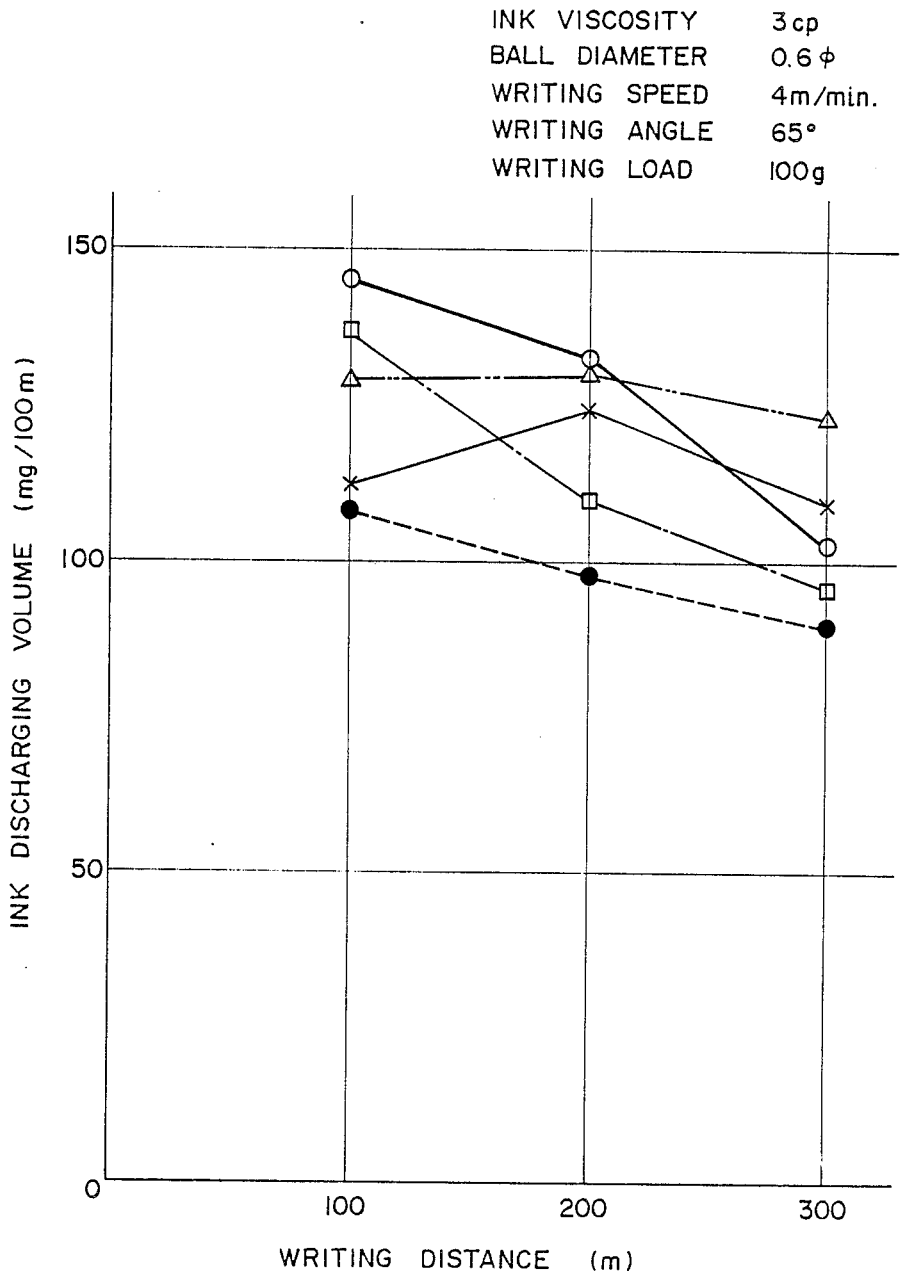

In the following table are described data obtained after a test of each of the performances in relation to the pen tips of the pesent invention (FIGS. 1, 13 and 17), the pen tip of the prior art (FIG. 47) and the pen tip of trial base for a comparison (FIG. 48).

A ball diameter of each of the pen tips is set as 0.6 $\phi$ and a viscosity of applied ink is 3 cp.

Figure 13:
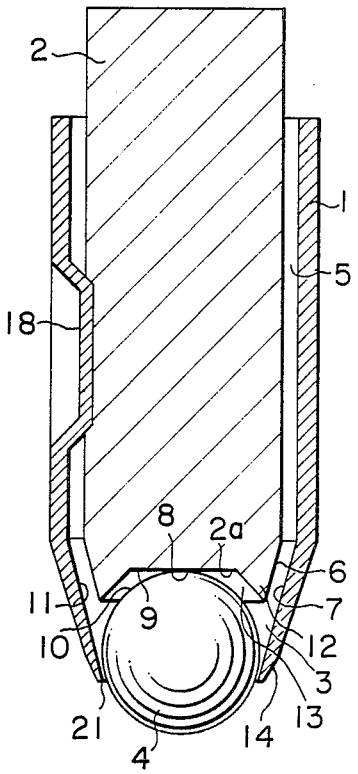
Figure 14:
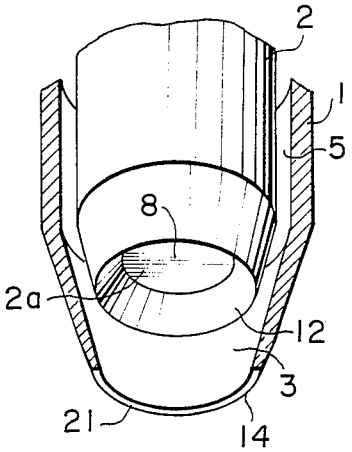
Figure 15:
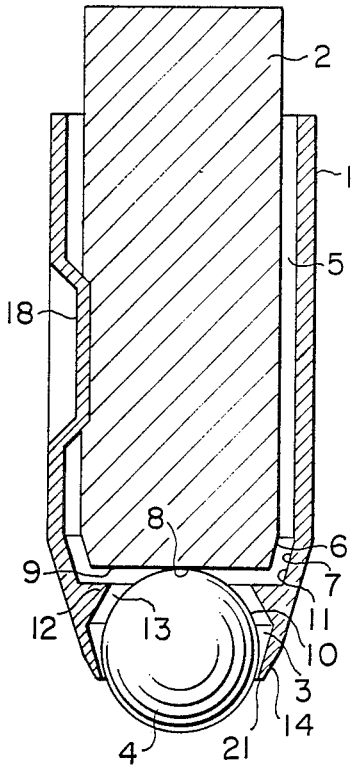

The pen tip of the prior art shown in FIG. 47 which is an item to be tested has the same constitution as that of the pen tip of the present invention shown in FIG. 1 except a difference in presence or non-presence of the ink capillary guiding vacant area in the ball wrapping part (3) and similarly the pen tip of the trial base shown in FIG. 48 has the same constitution as that of the pen tip of the present invention shown in FIG. 13 except a difference in presence or non-presence of the ink capillary guiding vacant area in the ball wrapping part (3). Further, the pen tip of the present invention shown in FIG. 17 has the same constitution as that of the pen tip of the present invention shown in FIG. 13 except a difference in constitution of the projecting wall (12).

The pen tip structure shown in FIG. 48 made in a trial base is constructed such that an axial extending ink passing space (72) is formed between the ball holding pipe (70) and the ball receiving core (71) and fixed in it, a communicating part of the ball wrapping part (73) in the ink passing space (72) is formed between a substantial trapezoidal tapered outer surface (75) having a top end of the flat ball receiving part (74) in the ball receiving core (71) and the inner surface part (76) of the ball holding pipe (70) which is parallel to the outer surface part, the ball (77) is rotatably held in the ball wrapping part (73), and the capillary guiding vacant area (82) showing no ink capillary guiding is present in a space (81) among the circumferential outer side part (78) of the ball receiving art (74), the surface part (79) of the ball (77) near the outer surface and the inner surface part (80) of the ball holding pipe (70).

Figure 17:
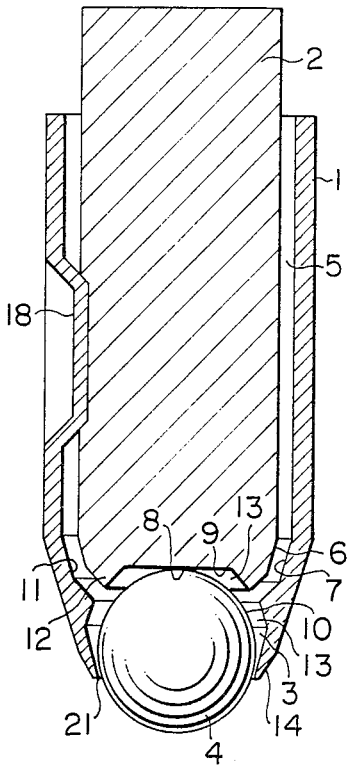
Figure 16:
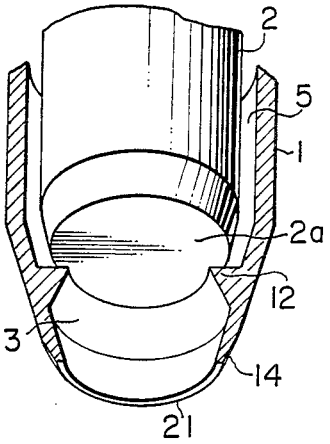
Figure 18:
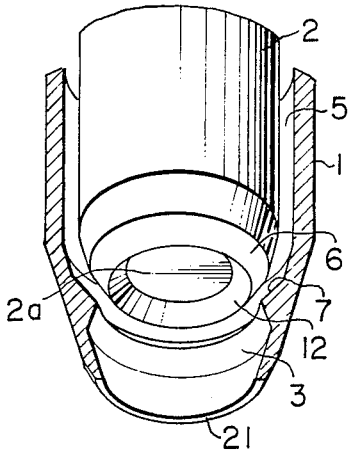
Figure 19:
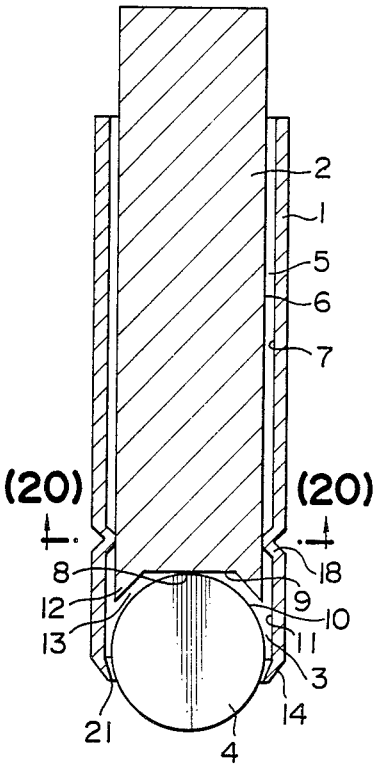
FIGS. 19 to 22 illustrate a pen tip structure in which a sectional shape at a diameter of an inner surface of a ball holding pipe and a contour shape of a sectional shape at a diameter of a ball receiving core are similarly rectangular shape and the ball is in a roll form, FIG. 19 being a longitudinal section, FIG. 20 being a cross sectional view taken along a line (20)—(20), FIG. 21 being a perspective view of the ball wrapping part, a portion of which is broken away
Figure 21:
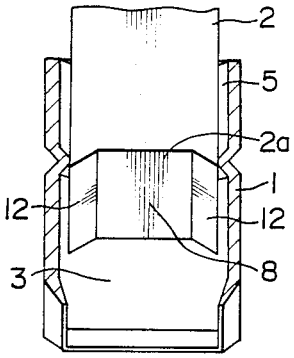
Figure 22:
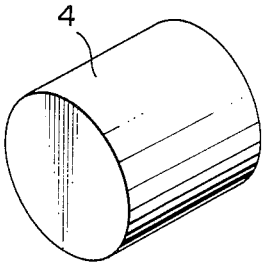
Figure 20:
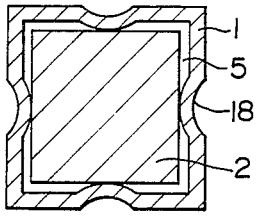
Figure 23:
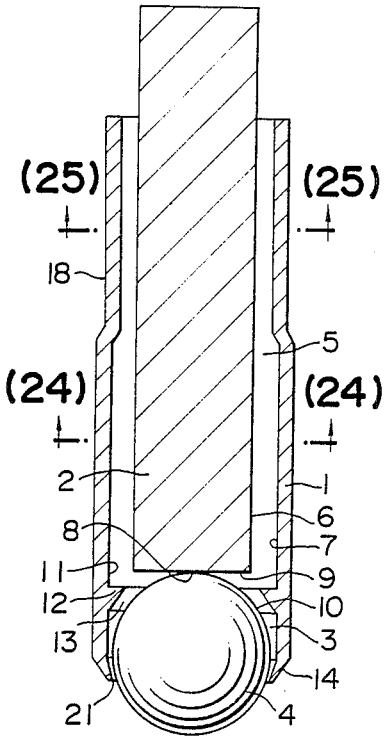
FIGS. 23 to 30 illustrate a pen tip structure in which a sectional shape at a diameter of an inner surface of a ball holding pipe and a contour shape of a sectional surface of a ball receiving core are irregularly shaped, FIGS. 23 and 27 being longitudinal sections, FIGS. 24 and 25 being cross sectional views taken along lines (24)—(24) and (25)—(25) of FIG. 23, respectively, FIGS. 28 and 29 being cross sectional views taken along lines (28)—(28) and (29)—(29) of FIG. 27, respectively.
Figure 26:
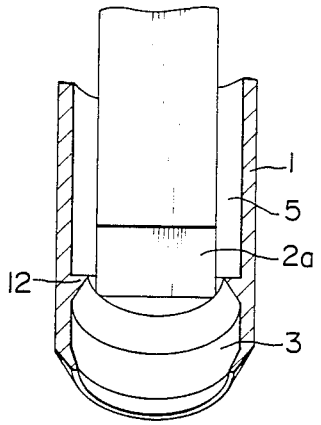
Figure 27:
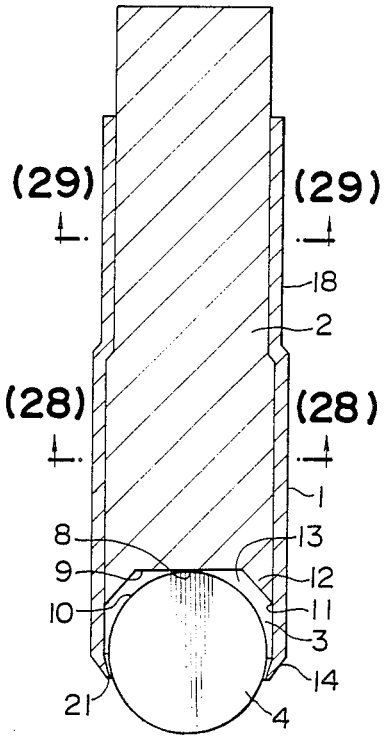
Figure 24:
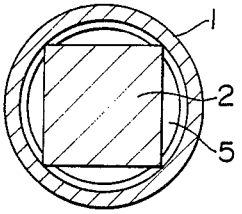
Figure 25:
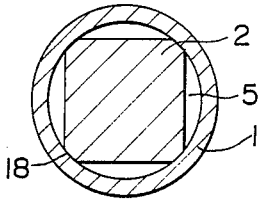
Figure 28:
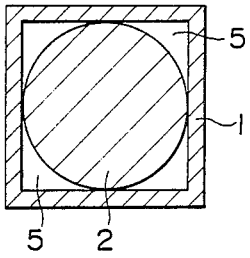
Figure 29:
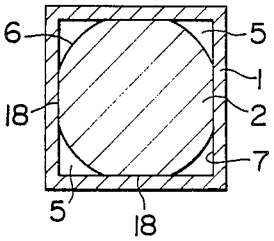
Figure 30:
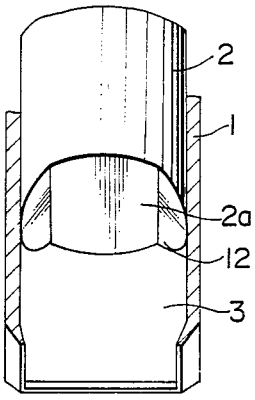
Figure 31:
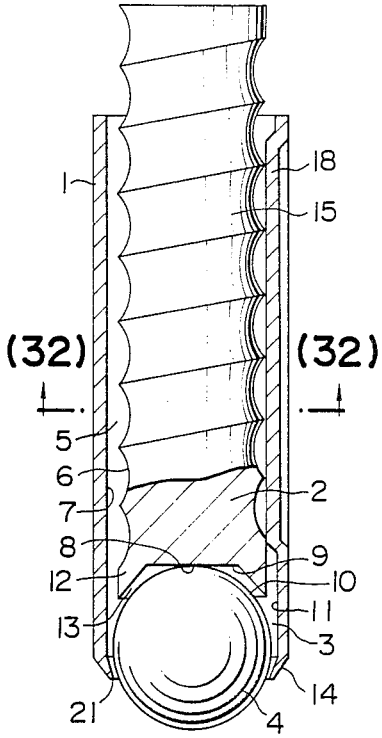
FIGS. 31 to 39 illustrate pen tip structures which include different types of grooves in the outer surfaces of the ball receiving cores, FIGS. 31, 34 and 37 being longitudinal sections, FIG. 32 being a cross sectional view taken along a line (32)—(32) of FIG. 31, FIG. 35 being a cross sectional view taken along a line (35)—(35) of FIG. 34, FIG. 38 being a cross sectional view taken along a line (38)—(38) of FIG. 7, FIGS. 33, 36 and 39 being perspective views of the respective ball wrapping parts, portions of which are broken away.
Figure 32:
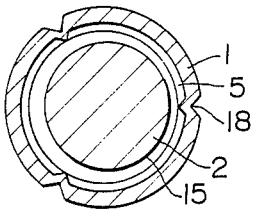
Figure 33:
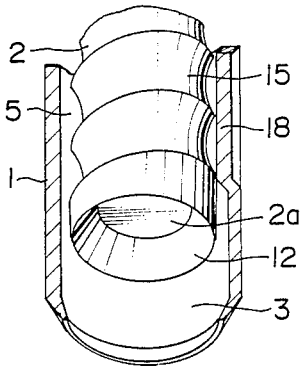
Figure 34:
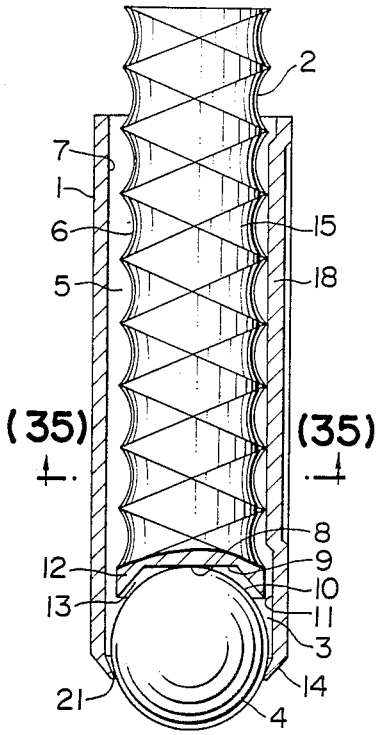

| Performance/Trial Product | | FIG. 47 | FIG. 1 | FIG. 48 | FIG. 13 | FIG. 17 |
|---|---|---|---|---|---|---|
| Anti-drain back Characteristic(1) | | X (70%) | ○ (80%) | Δ (75%) | ◎ (95%) | ◎ (95%) |
| Writing Condition | Vertical Writing | ○ | ○ | ○ | ○ | ○ |
| | Slant Writing | ○ | ○ | ○ | ○ | ○ |
| High-Speed Writing Characteristic(2) | | X | ○ | Δ | ◎ | ○ |
| Ink Discharging Volume(3) | | Δ | ○ | Δ | ○ | ○ |
| Return Characteristic(4) | | X (20%) | ○ (40%) | Δ (28%) | ◎ (60%) | ◎ (63%) |
| Initial Writing Characteristic (Initial Writing)(5) | | X (4%) | ○ (90%) | Δ (42%) | ◎ (100%) | ◎ (100%) |
| Writing Touch | | ○ | ○ | ○ | ○ | ○ |
| Working Characteristic | Metal | ◎ | Δ | ○ | ◎ | Δ |
| | Plastic Ceramics | ◎ | ○ | ○ | ○ | Δ |

EVALUATION

Excellent - ◎ -○-Δ-x-Inferior (1) A percentage of the number of pen tips of which upward directed writing could be performed after the test product of which downward directed writing could be performed was left in a thermohygrostat of 60° C. for one week with its pen tip being directed upward.

(2) 60 cm/sec.

(3) Writing Speed: 4 m/min.; Writing Angle 65°; Writing Load: 100 g.

(4) A percentage of the number of the test products of which drain-backs were confirmed, where the downward directed writing could be performed after being left in their downward directed condition.

(5) A percentage of the number of the test products in which they were assembled to the main body of the pen, thereafter the test products were directed downwardly in silence and left as they were for one hour and then the inks were reached to the ball in their natural dropping action.

FIGS. 49 to 52 illustrate the ink discharging volume during writing operation in respect to the data of the pen tip of the present invention (FIGS. 49 and 50) in which the ink capillary guiding vacant area is not present in the ball wrapping part (3) and the data of the pen tip in which the ink capillary guiding vacant area is present in the ball wrapping portions (53) and (73) (FIGS. 51 and 52) and five pen tips which were randomly selected were tested, respectively.

In view of the above table and data, it was confirmed that the pen tip structure in which the ink capillary guiding vacant area is present in the ball wrapping part was inferior in anti-drain back characteristic, high-speed writing, return characteristic and initial writing characteristics and much amount of disturbance were acknowledged in the ink discharging volume.

In turn, the pen tip structure of the present invention in which the ink capillary guiding vacant area is not present in the ball wrapping part is, as apparent from the table and data, superior in its anti-drain back characteristic, high-speed writing, return-back characteristic and initial writing, and further it is confirmed that the disturbance in ink discharging volume is decreased and made uniform and it shows a high reliability as a practical product.

APPLICABILITY IN THE INDUSTRY

As described above, the pen tip structure of the present invention is useful for a writing, drawing and a make-up pen tip and in particular it is suitable for the application requiring a superior anti-drain back characteristic, a high-speed writing, ink discharging volume, a return-back feature and initial writing and a durability against a high writing pressure as well as a smooth rotation of the ball in particular.

What is claimed is:

1. A pen tip structure which comprises an elongated core which has a generally cylindrical outer surface, a first end for contact with an ink-containing material and a second end for supporting a rotatable sphereical ball, said second end having a recess therein shaped to provide a flat, circular center surface and an annular projection surface which flares outwardly from the periphery of said flat, circular center surface, a pipe which includes a shank portion positioned around said elongated core and an end portion located beyond said second end of said elongated core, said shank portion of said pipe defining an inner surface and including a plurality of indentations therein which contact the cylindrical outer surface of said elongated core and thereby provide a longitudinal ink flow channel between said cylindrical outer surface of said elongated core and said inner surface of said shank portion of said pipe along which ink can flow by capillary action, said end portion of said pipe including an inwardly-extending tip which provides a mouth for retaining a rotatable ball between said tip and said second end of said elongated core, and a rotatable ball positioned between said mouth of said pipe and said second end of said elongated core, said rotatable ball having a surface, a first portion of said surface extending beyond said mouth of said pipe and an opposite, second portion of said surface being in rubbing contact with said flat, circular center surface of said second end of said elongated core, said rotatable ball having a diameter such that a gap is formed between said surface of said rotatable ball and said annular projection surface which will enable ink to pass therethrough from said ink flow channel to said surface of said rotatable ball by capillary action.

2. A pen tip structure according to claim 1, wherein said annular projection surface at said second end of said elongated core extends to said generally cylindrical outer surface thereof.

3. A pen tip structure according to claim 2, wherein said annular projection surface is straight in cross section.

4. A pen tip structure according to claim 1, wherein said second end of said elongated core includes an annular, inwardly-sloped outer surface portion which merges with said annular projection surface.

5. A pen tip structure according to claim 4, wherein said inner surface of said pipe forms an annular lip which extends towards said second surface portion of said rotatable ball adjacent said second end of said elongated core, said annular lip and said annular, inwardly-sloped outer surface portion of said elongated core forming an annular connecting channel which enables ink to flow by capillary action from said ink flow channel to said gap and to said second surface portion of said rotatable ball.

6. A pen tip structure according to claim 4, wherein said second end of said elongated core includes a plurality of radially-extending grooves which extend from said annular, inwardly-sloped outer surface portion to said annular projection surface, said radially-extending grooves having a width that enable ink to flow therethrough by capillary action.

7. A pen tip structure according to claim 1, wherein each of said plurality of indentations in said shank portion of said pipe extend axially of said pipe.

8. A pen tip structure according to claim 1, wherein the radial spacing between said cylindrical outer surface of said elongated core and said inner surface of said pipe is between 25 and 110 $\mu$.

9. A pen tip structure according to claim 1, wherein the spacing between said rotatable ball and said annular projection surface at said second end of said elongated core does not exceed 100 $\mu$.

10. A pen tip structure according to claim 1, wherein said elongated core is composed of stainless steel.

11. A pen tip structure according to claim 10, wherein said rotatable ball is composed of stainless steel.

12. A pen tip structure according to claim 10, wherein said rotatable member is composed of a ceramic material.

13. A pen tip structure according to claim 10, wherein said pipe is composed of stainless steel.

14. A pen tip structure according to claim 10, including a resin coating on said cylindrical outer surface of said elongated core.

15. A pen tip structure according to claim 1, wherein said tip at said end portion of said pipe is spaced from said ball by 5 to 15 $\mu$.

16. A pen tip structure according to claim 1, wherein said second end of said elongated core includes a plurality of radially-extending grooves which extend from said cylindrical outer surface thereof through said annular projection surface, said radially-extending grooves having a width that enables ink to flow therethrough by capillary action.

17. A pen tip structure according to claim 1, wherein said elongated core has an outer diameter which is substantially equal to the diameter of said ball.

18. A pen tip structure according to claim 1, wherein said elongated core has an outer diameter which is larger than the diameter of said ball.

19. A pen tip structure according to claim 1, wherein each of said plurality of indentations in said shank portion of said pipe extend circumferentially of said pipe.

20. A pen tip structure according to claim 1, wherein the generally cylindrical outer surface of said elongated core includes a single axial spiral groove therein.

21. A pen tip structure according to claim 1, wherein the generally cylindrical outer surface of said elongated core includes a double axial spiral groove therein.

22. A pen tip structure according to claim 1, wherein the generally cylindrical outer surface of said elongated core includes a plurality of axially-spaced annular grooves therein.

* * * * *